US011022270B2

(12) United States Patent
Menn

(10) Patent No.: US 11,022,270 B2
(45) Date of Patent: Jun. 1, 2021

(54) HEADLIGHT UNIT

(71) Applicant: VALEO VISION, Bobigny (FR)

(72) Inventor: Thibaut Menn, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/482,929

(22) PCT Filed: Feb. 23, 2018

(86) PCT No.: PCT/EP2018/025044
§ 371 (c)(1),
(2) Date: Aug. 1, 2019

(87) PCT Pub. No.: WO2018/153552
PCT Pub. Date: Aug. 30, 2018

(65) Prior Publication Data

US 2020/0003390 A1 Jan. 2, 2020

(30) Foreign Application Priority Data

Feb. 24, 2017 (FR) ..... 1751518

(51) Int. Cl.
*F21S 45/435* (2018.01)
*F21S 41/20* (2018.01)
*F21S 43/20* (2018.01)

(52) U.S. Cl.
CPC ..... *F21S 45/435* (2018.01); *F21S 41/28* (2018.01); *F21S 43/26* (2018.01)

(58) Field of Classification Search
CPC ..... F21S 45/42–43; F21S 45/435; F21V 29/60–61; F21V 29/65; F21V 29/503–504; F21V 29/506
See application file for complete search history.

(56) References Cited

U.S. PATENT DOCUMENTS

2016/0208997 A1 7/2016 Silvi
2016/0348870 A1* 12/2016 Kim ..... F21S 45/60

FOREIGN PATENT DOCUMENTS

CN 101849135 9/2010
CN 106195851 12/2016
DE 10 2007 043 961 A1 3/2009
DE 10 2008 062 827 A1 7/2010
DE 102008062827 A1 * 7/2010 ..... F21S 41/143
DE 10 2014 110 605 A1 1/2016

OTHER PUBLICATIONS

International Search Report dated Jul. 9, 2018 in PCT/EP2018/025044 filed Feb. 23, 2018.
Chinese Office Action issued in Chinese Patent Application No. 2018800137852 dated Jan. 25, 2021, citing documents AO-AQ therein (w/ English Summary).

* cited by examiner

*Primary Examiner* — Sean P Gramling
(74) *Attorney, Agent, or Firm* — Oblon, McClelland, Maier & Neustadt, L.L.P.

(57) ABSTRACT

A headlight unit including a cooling circuit provided with at least two air circulation pipes linked to at least a same device for generating an air flow, particularly a fan, and provided with at least one element for varying a proportion of the air flow, which proportion is distributed into each of the at least two pipes.

16 Claims, 3 Drawing Sheets

HEADLIGHT UNIT

The present invention relates to a headlight unit and a method for managing an air circulation in this headlight unit and a system for implementing this method.

The invention also relates to a vehicle, particularly a motor vehicle, comprising such a managing system.

The invention also relates to a computer program including program code instructions for executing the steps of this method.

Motor vehicle headlight units must be cooled, all the more so since they include several lighting modules, such as to prevent any malfunction that can lead to a decrease or a total loss of the lighting function provided by the latter.

For this purpose, with reference to FIG. 1, headlight units 100 are known from the prior art which include a housing 104 and an outer lens 105 defining an enclosure 106 that includes a cooling circuit 101, a fan 102 and lighting modules 103*a*, 103*b*. In these headlight units 100, the cooling circuit 101 links the fan 102 to the lighting modules 103*a*, 103*b* of these units 100. Such a fan 102 operates once the engine of the vehicle is running and makes it possible to spread a constant air flow towards these lighting modules 103*a*, 103*b*.

However, one of the disadvantages of such headlight units 100 is linked to the fact that the cooling of the lighting modules 103*a*, 103*b* is not optimized. Indeed, the spread of such a constant air flow by this fan 102 does not make it possible to adjust the cooling of the lighting modules 103*a*, 103*b* to the progressions of the outside temperatures to which the vehicle and therefore, as a result, the headlight unit 100, can be subjected, nor to the operating conditions of the lighting modules 103*a*, 103*b*.

Moreover, such headlight units 100 are often subject to condensation phenomena which appear at the outer lens 105 thereof and which manifest themselves through the appearance of droplets on an inside surface of this outer lens 105. This phenomenon appears in certain temperature conditions, particularly during thermal shock caused by a substantial difference in temperature between firstly the warm temperature coming from the engine (particularly for a headlight unit arranged at the front of the vehicle) and secondly the outside temperature which can be low. Such condensation phenomena are often the cause of malfunction of these headlight units 100 resulting from deteriorations caused by the presence of a high level of humidity in the enclosure 106 of these units 100, which presence is linked to these phenomena. Moreover, the appearance of these condensation phenomena at the outer lens 105 of the headlight unit 100 often leads to the vehicle owner perceiving a deterioration in the aesthetic appearance of this headlight unit 100 which inevitably results in discontent on the part of the owner followed by this vehicle being returned to the after-sales service of the car manufacturer.

The aim of the present invention is to overcome these disadvantages linked to the prior art.

One of the aims of the invention is to improve the cooling of headlight units including several lighting modules.

Another aim of the invention is to reduce, or eliminate, the condensation phenomena in headlight units.

To this end, the invention relates to a headlight unit including a cooling circuit provided with at least two air circulation pipes linked to at least a same device for generating an air flow, particularly a fan, and provided with at least one element for varying a proportion of the air flow, which proportion is distributed into each of said at least two pipes.

In other embodiments:

said at least one varying element is a mobile wall arranged in a junction zone of an air inlet pipe of said cooling circuit with said at least two air circulation pipes;

the headlight unit includes a clean air circulation pipe connected to each lighting module;

the headlight unit includes an outer lens and at least one lighting module and it includes an air circulation pipe, the end of which is connected to the outer lens and at least one separate air circulation pipe, the end of which is connected to at least one lighting module;

said at least one device for generating an air flow is linked to an air inlet pipe of said cooling circuit.

The invention also relates to a method for managing an air circulation in this headlight unit, including a step for varying the air flow proportion distributed into each of said at least two air circulation pipes of the cooling circuit of the headlight unit.

Advantageously, the varying step includes a sub-step for configuring the cooling circuit in a first mode of operation in which the entire air flow is guided towards a single lighting module or an outer lens or in a second mode of operation in which the air flow is split between at least two air circulation pipes.

In particular, the configuring sub-step takes into account all or some of the following data:

the on or off state of each lighting module;

the temperature of at least one lighting module;

the temperature inside the headlight and/or outside;

the humidity level measured in the headlight unit outer environment.

The invention also relates to a system for managing an air circulation in such a headlight unit implementing this method, the system including a control unit driving at least one element for varying a proportion of the air flow, which proportion is distributed into each of said at least two pipes of the cooling circuit of the headlight unit.

Advantageously, the system includes at least one device for generating an air flow, particularly a centrifugal fan, at least one temperature sensor, at least one temperature sensor and/or at least one humidity sensor measuring the temperature and the humidity level, respectively, that are present in the outer environment of the headlight unit and/or at least one temperature sensor included in an enclosure of the headlight unit.

In particular, the managing system includes at least one temperature sensor arranged in a lighting module of said headlight unit.

The invention also relates to a vehicle, particularly a motor vehicle, including at least one such headlight.

The invention also relates to a computer program including program code instructions for executing the steps of this method when said program is executed by a control unit of this managing system.

Other advantages and features of the invention will emerge more clearly upon reading the description of a following preferred embodiment, with reference to the figures, which embodiment is given as an indicative and nonlimiting example:

In the following description, identical reference numbers designate pieces that are identical or have similar functions.

Figure 1:
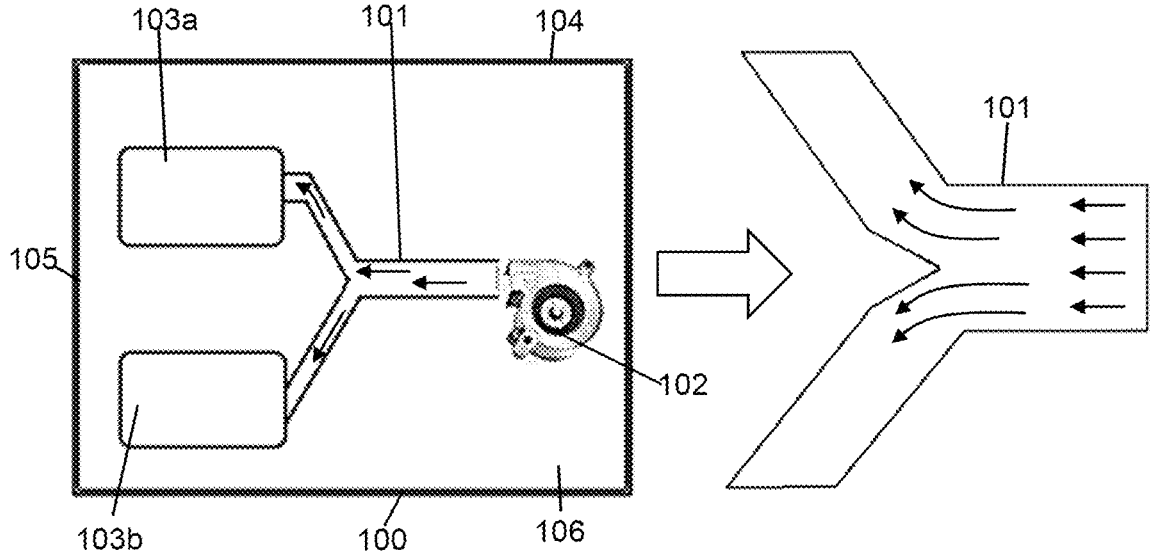
FIGURE 1 (PRIOR ART)
FIG. 1 is a graphic representation of a headlight unit including a cooling circuit from the prior art.
Figure 2:
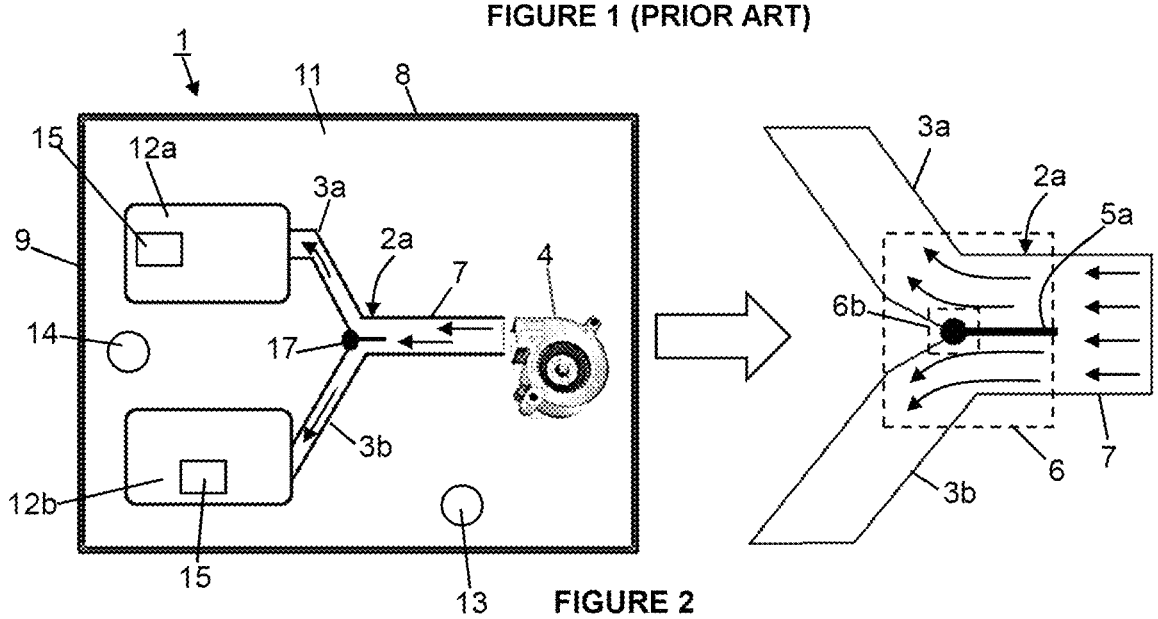
FIG. 2 is a graphic representation of a headlight unit including a first variation of a cooling circuit provided with a single varying element, according to the embodiment of the invention.
Figure 3:
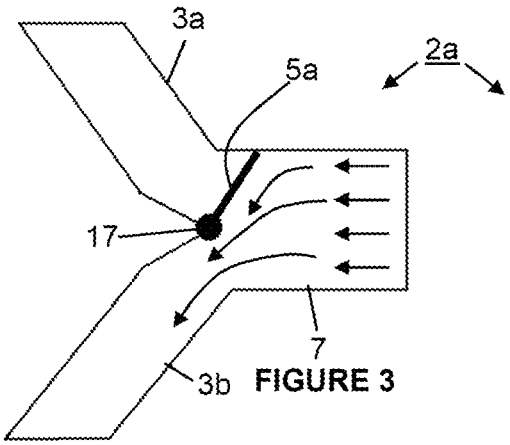
FIG. 3 is a graphic representation of the first variant of the cooling circuit, which variant is configured in a first mode of operation, according to the embodiment of the invention.
Figure 7:
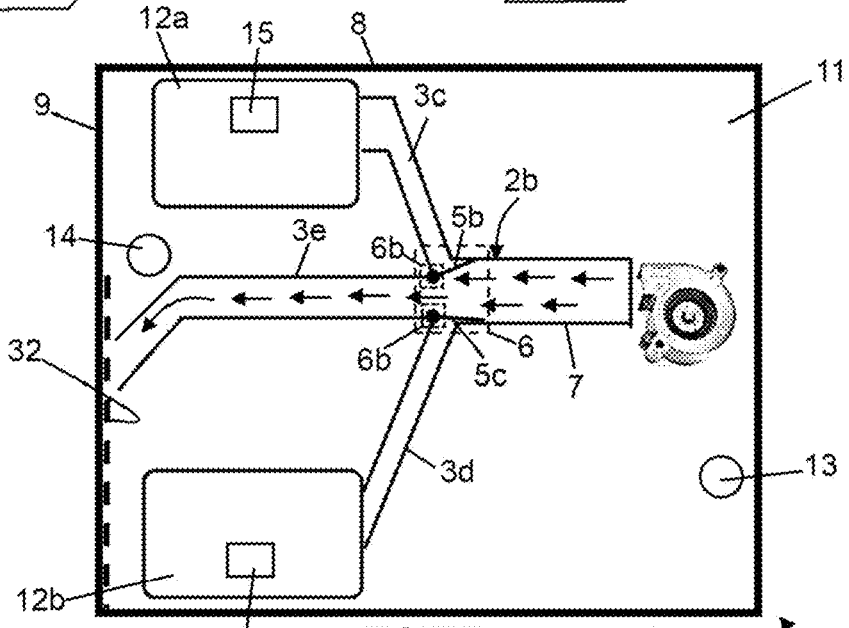
FIG. 7 is a graphic representation of the headlight unit including a second variant of the cooling circuit, which variant is configured in the first mode of operation and comprises two varying elements, according to the embodiment of the invention.
Figure 8:
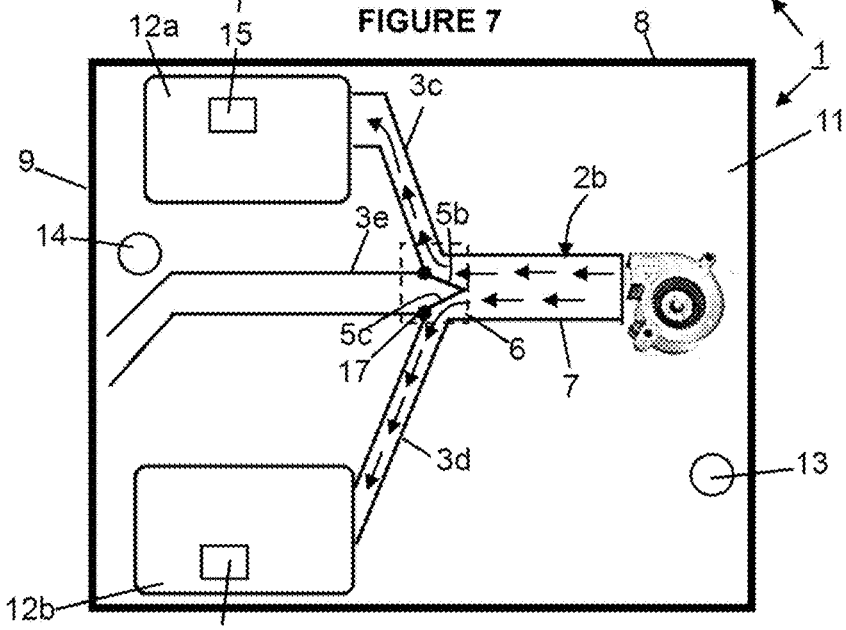
FIG. 8 is a graphic representation of the headlight unit including the second variant of the cooling circuit, which second variant is configured in the second mode of operation and comprises two varying elements, according to the embodiment of the invention.

FIGS. 2, 7 and 8 show an embodiment of a headlight unit 1 that can emit light radiation. This headlight unit 1 is preferably arranged in a vehicle, for example a sea, air or land-based vehicle. Alternatively, it can be included in an inside or outside lighting device of a building or in a public lighting device.

In the present embodiment, the vehicle in which the headlight unit 1 is arranged is preferably a motor vehicle. In this context, the headlight unit 1 is located at a rear or front part of the vehicle.

Such a headlight unit 1 essentially includes a housing 8 defining an opening closed by a transparent outer lens 9 through which the light rays emitted by at least one lighting module 12*a*, 12*b* of this headlight unit 1 can pass.

The housing 8 and the outer lens 9 assembled in this manner together define an enclosure 11 of this headlight unit 1 including each lighting module 12*a*, 12*b*. This headlight unit 1 preferably includes two lighting modules 12*a*, 12*b* which can, for example, correspond to a high beam module and a low beam module. It is clearly understood that this headlight unit 1 can additionally comprise other lighting modules such as a daytime running light module or a position light module. This enclosure 11 can also include at least one temperature sensor 13 for the outer lens 9, which temperature sensor is preferably arranged at a distance from the lighting modules 12*a*, 12*b*.

In this headlight unit 1, each lighting module 12*a*, 12*b* includes a light source like, in particular, a light bulb, a halogen lamp, a xenon lamp, one or more LEDs or one or more laser diodes. The lighting module 12*a*, 12*b* can also include at least one temperature sensor 15.

The headlight unit 1 also includes a cooling circuit 2*a*, 2*b* provided with at least two air circulation pipes 3*a*, 3*b*, 3*c*, 3*d*, 3*e* linked by means of an air inlet pipe 7 to at least one device for generating 4 an air flow. The circulation pipes 3*a*, 3*b*, 3*c*, 3*d*, 3*e* can be linked to a same device for generating 4 air flow or to several of these devices 4. The inlet pipe 7 includes an end provided with an inlet opening of the cooling circuit 2*a*, 2*b* through which air enters the latter. As regards said at least two air circulation pipes 3*a*, 3*b*, 3*c*, 3*d*, 3*e*, they each include an end provided with an outlet opening of the cooling circuit 2*a*, 2*b* allowing the air circulating in this circuit 2*a*, 2*b* to be evacuated towards the lighting modules 12*a*, 12*b* and/or the outer lens 9 of the headlight unit 1.

This headlight unit 1 comprises two cooling circuit 2*a*, 2*b* variants. The difference between the first and second variants is the presence of an air circulation pipe 3*e* in this second variant which is intended to carry an air flow or a proportion of the latter towards the outer lens 9 of the headlight unit 1.

In the first variant that can be seen in FIGS. 2 to 6, the cooling circuit 2*a* includes an air inlet pipe 7 which is linked at a junction zone 6 to two air circulation pipes 3*a*, 3*b*. In this configuration, the end of each of these air circulation pipes 3*a*, 3*b* is connected to the corresponding lighting module 12*a*, 12*b* of the headlight unit 1. It is understood in this case that this first variant of the cooling circuit 2*a* preferably includes as many air circulation pipes 3*a*, 3*b* as the headlight unit 1 advantageously includes lighting modules 12*a*, 12*b*.

In the second variant that can be seen in FIGS. 7 and 8, the cooling circuit 2*b* also includes the air inlet pipe 7 which is linked at a junction zone 6 to three air circulation pipes 3*c*, 3*d*, 3*e*. In this configuration, the ends of two 3*c*, 3*d* of these three air circulation pipes 3*c*, 3*d*, 3*e* are connected to the lighting modules 12*a*, 12*b* of the lighting unit 1, the end of the remaining air circulation pipe 3*e* being arranged close to the front lens 9 of this headlight unit 1. In particular, the outlet opening of this end of the air circulation pipe 3*e* is preferably positioned facing said outer lens 9. Furthermore, in addition to the remaining air circulation pipe 3*e*, this second variant of the cooling circuit 2*b* preferably includes as many air circulation pipes 3*c*, 3*d* as the headlight unit 1 includes lighting modules 12*a*, 12*b*.

This headlight unit 1 also includes at least one element for varying 5*a*, 5*b*, 5*c* the air flow proportion distributed into each of said at least two pipes 3*a* to 3*e* of the first or of the second variation of the cooling circuit 2*a*, 2*b*. More precisely, the first variant of this cooling circuit 2*a* includes a single varying element 5*a* and the second variant of this circuit 2*b* includes two varying elements 5*b*, 5*c*.

In these two variants of the cooling circuit 2*a*, 2*b*, each varying element 5*a*, 5*b*, 5*c* is a mobile wall which is arranged completely or partially in the junction zone 6 of the air inlet pipe 7 with said at least two air circulation pipes 3*a*, 3*b*, 3*c*, 3*d*, 3*e*. This mobile wall includes a body which preferably extends in a straight line between two ends 17 of this wall. This wall is rotatably mounted in the first and second variants of the cooling circuit 2*a*, 2*b*. For this purpose, the first end 17 of this wall is fixed in these first and second variants of the cooling circuit 2*a*, 2*b* in a region for linking 6*b* two air circulation pipes 3*a*, 3*b*, 3*c*, 3*d*, 3*e* to one another, said linking region 6*b* being included in the junction zone 6. Thus, the first end 17 defines a rotation axis around which the mobile wall can be moved. In other words, this rotation axis is included in the region for linking 6*b* the two air circulation pipes 3*a*, 3*b*, 3*c*, 3*d*, 3*e* to one another. It will be noted that the mobile wall has a surface area which is substantially greater than or equal to the surface area of the section of each air circulation pipe 3*a*, 3*b*, 3*c*, 3*d*, 3*e* which are included in the two cooling circuit 2*a*, 2*b* variations, particularly a circular surface area since these pipes 3*a*, 3*b*, 3*c*, 3*d*, 3*e* each have a circular cross-section. It will be noted that this wall can be coupled to an electric motor-type actuating device in order to move it in the cooling circuit 2*a*, 2*b*.

In the headlight unit 1, the device for generating 4 the air flow can be a fan, particularly an axial flow fan arranged in the air inlet pipe 7. This axial flow fan can generate an air flow in the cooling circuit 2*a*, 2*b* by sucking the air entering through the inlet opening of the circuit 2*a*, 2*b* and propelling it into the latter parallel to the rotation axis of the fan. In other variants, this fan can be a centrifugal fan or include any apparatus with the capacity to blow air.

Figure 9:
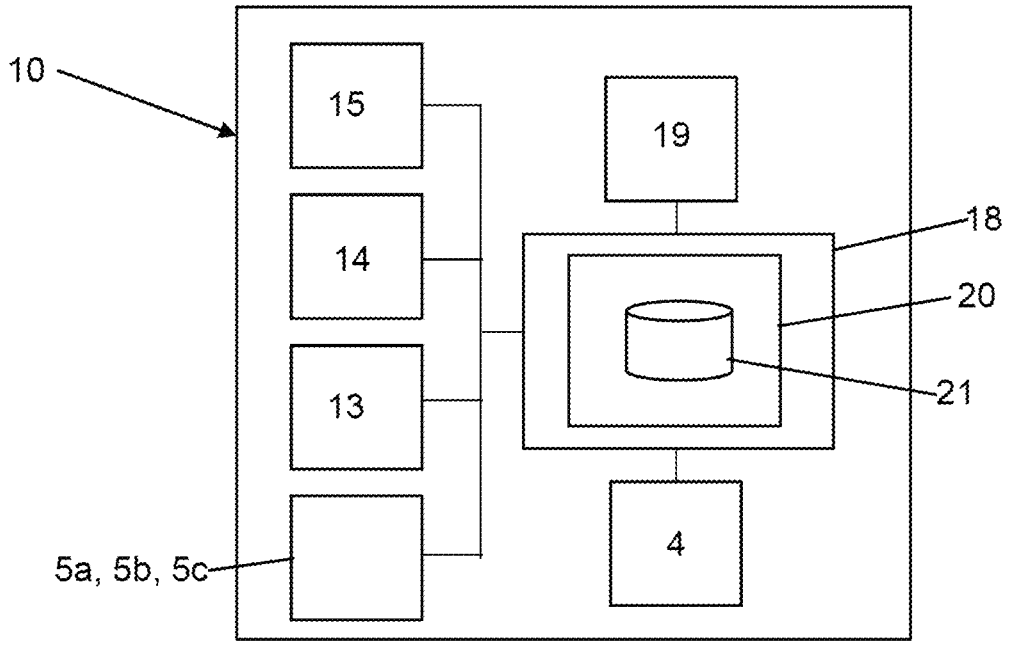
FIG. 9 is a graphic representation of a system for managing an air circulation in the headlight unit, according to the embodiment of the invention.

With reference to FIG. 9, the invention also relates to a system for managing 10 the air circulation in the headlight unit 1. This managing system 10 includes a control unit 18 driving at least one varying element 5*a*, 5*b*, 5*c*. It also includes said at least one temperature sensor 13, 15 which are arranged in the headlight unit 1 and said at least one varying element 5*a*, 5*b*, 5*c* and said at least one device for generating 4 air flow. In addition, the system 10 can also include at least one temperature sensor 19 and at least one humidity sensor 14 measuring the temperature and the humidity level, respectively, that are present in the outer environment of the headlight unit, i.e. in the outer environment of the vehicle defined at an outer face of the outer lens 9 of this headlight unit 1. In this managing system 10, the control unit 18 comprises hardware and software resources, more precisely at least one processor cooperating with memory elements 20. The control unit 18 can execute instructions for implementing a computer program.

Such a control unit 18 is connected to each:

temperature sensor 13, 15, 19;

humidity sensor 14;

varying element 5*a*, 5*b*, 5*c*, and device for generating 4 the air flow.

It will be noted that, in this managing system 10, the device for generating 4 the air flow can be, as stated, included inside the headlight unit 1 by being located in the air inlet pipe 7. Alternatively, it can be positioned outside the latter by being linked to the inlet opening of the air inlet pipe 7. In the latter case, this generating device 4 can be a fan, particularly a centrifugal fan. Such a centrifugal fan can then generate an air flow in the cooling circuit 2*a*, 2*b* by sucking the air in parallel with the rotation axis of the fan and propelling it by centrifugal force perpendicular to this same axis.

Figure 10:
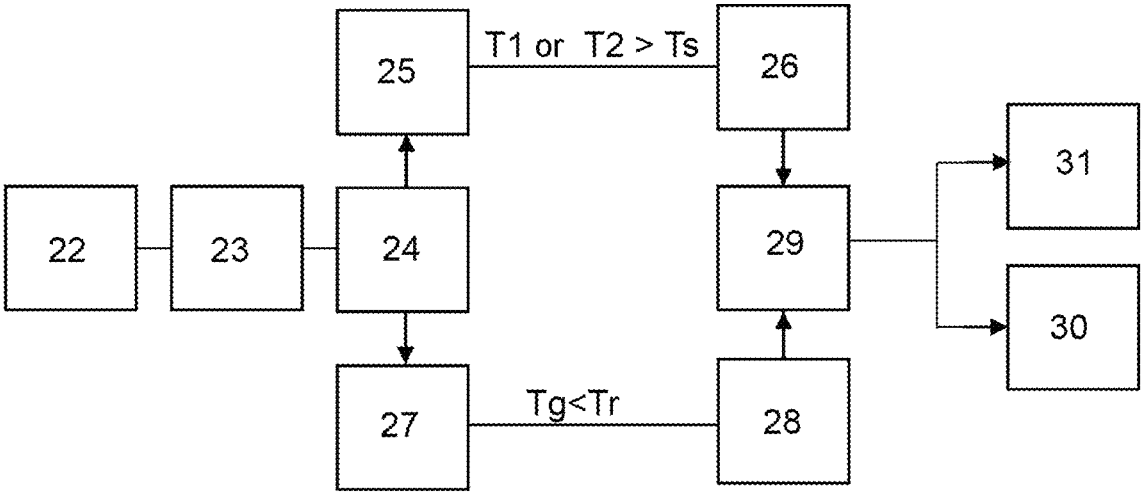
FIG. 10 is a logical diagram relating to the method for managing an air circulation in the headlight unit, according to the embodiment of the invention.

With reference to FIG. 10, such a managing system 10 can implement a method for managing the air circulation in the headlight unit 1.

This method includes a step for starting 22 said at least one device for generating 4 air flow. This step 22 is preferably carried out by the control unit 18 once the latter detects that the engine of the vehicle has started. Alternatively, such a step 22 can provide conditions for initiating this starting of the device for generating 4 air flow which are linked, for example, to the detection of heating of one of the lighting modules 12*a*, 12*b* of the lighting unit 1 or to the detection of a condensation phenomenon 32 appearing at the outer lens 9 of the headlight unit 1 when the latter includes the second variant of the cooling circuit 2*b*.

The method then provides a step for varying 23 a proportion of the air flow, which proportion is distributed into each of said at least two pipes 3*a* to 3*e* of the cooling circuit 2*a*, 2*b* of the headlight unit 1.

Such a step 23 includes a sub-step for configuring 24 the cooling circuit 2*a*, 2*b* in a first mode of operation. The first mode of operation provides orientation of the entire air flow generated by the device for generating 4 air flow into either of said at least two air circulation pipes 3*a*, 3*b*, 3*c*, 3*d*, 3*e*. In other words, in this first mode of operation, the flow proportion distributed into either of said at least two pipes can be zero. Thus, in the first and second variants of the cooling circuit 2*a*, 2*b*, the entire air flow is then directed towards either of the lighting modules 12*a*, 12*b* which are connected to the ends of two air circulation pipes 3*a*, 3*b*, 3*c*, 3*d*. This first operating mode is, for example, illustrated in FIG. 3 when the headlight unit 1 includes the first variation of the cooling circuit 2*a*. Additionally, in the second variant 2*b* and with reference to FIG. 7, all of this air flow can be oriented towards the outer lens 9 of the headlight unit 1.

This sub-step 24 can include a stage for detecting 25 heating of one of the lighting modules 12*a*, 12*b* of the headlight unit 1 that is connected to one of said at least two air circulation pipes 3*a*, 3*b*, 3*c*, 3*d*. During this stage 25, temperatures T1, T2 of the lighting modules 12*a*, 12*b* of the headlight unit 1 are measured using temperature sensors 15 included in these lighting modules 12*a*, 12*b*. Subsequently, each of these temperatures T1, T2 is transmitted to the control unit 18 in order to be compared with a threshold temperature Ts included in the memory elements 20 of this control unit 18. If one of these temperatures T1, T2 is greater than the threshold temperature Ts, then the corresponding lighting module 12*a*, 12*b* exhibits an abnormal and/or detrimental increase in the temperature thereof and the configuring sub-step 24 then provides, under these conditions, for carrying out a stage for driving 26 at least one varying element 5*a*, 5*b*, 5*c* of the headlight unit 1, such as to result in the lighting module in question being cooled.

During this driving stage 26, the control unit 18 then drives said at least one varying element 5*a*, 5*b*, 5*c* in order to direct the entire air flow towards the lighting module 12*a*, 12*b* exhibiting this heating. In the case of the first variant of the cooling circuit 2*a*, the varying element 5*a* is driven such as to be in a position for blocking the air circulation pipe 3*a*, 3*b* connected to the lighting module 12*a*, 12*b* which does not exhibit heating. In the case of the second variant of this circuit 2*b*, the two varying elements 5*b*, 5*c* are driven by the control unit 18 such as to be in positions for blocking the air circulation pipe 3*e* that can lead the air flow to the outer lens 9 of the headlight unit 1 and the air circulation pipe 3*c*, 3*d* connected to the lighting module 12*a*, 12*b* not exhibiting heating.

When the headlight unit 1 includes the second variant of the cooling circuit 2*b*, this sub-step 24 can also include, in addition to the preceding detecting stage 25, a stage for detecting 27 a condensation phenomenon 32 appearing at the outer lens 9 of the headlight unit 1. During this stage 27, the control unit 18 determines a temperature Tg of the outer lens 9 of the headlight unit 1 and then compares it with a threshold temperature Tr. This threshold temperature Tr is a dew-point temperature also called "dew point", which is determined in advance of carrying out the detecting stage 27 or as this stage 27 takes place. This threshold temperature Tr can be determined by the control unit 18 from temperatures and humidity levels measured in the outer environment of the headlight unit 1 and from implementing equations that are well known from the prior art for determining the dew-point temperature like the Heinrich Gustav Magnus-Tetens equation. In so far as the temperature Tg of the outer lens 9 is less than this threshold temperature Tr, a condensation phenomenon 32 is then present at this outer lens 9 of the headlight unit 1.

In this context, the configuring sub-step 24 then provides, following this detecting stage 27, for carrying out a stage for driving 28 the varying elements 5*b*, 5*c* of the headlight unit 1. During this driving stage 28, the control unit 18 then drives the two varying elements 5*b*, 5*c* in order to direct the entire air flow towards the outer lens 9 of the headlight unit 1. Thus, with reference to FIG. 7, the two varying elements 5*b*, 5*c* are driven by the control unit 18 such as to be in positions for blocking the air circulation pipes 3*c*, 3*d* connected to the lighting modules 12*a*, 12*b*.

Additionally or alternatively with respect to a temperature measurement, the configuring sub-step 24 can take into account the state of a lighting module (on or off), in order to provide cooling only when it is on.

Subsequently, the varying step 23 includes a sub-step for configuring 29 the cooling circuit 2 in a second mode of operation. This second mode of operation provides for spreading the air flow generated by the device for generating 4 air flow into said at least two air circulation pipes 3*a*, 3*b*, 3*c*, 3*d*, 3*e*, according to a nonzero variable proportion of this flow, which proportion is distributed into each of these at least two air circulation pipes 3*a*, 3*b*, 3*c*, 3*d*, 3*e*.

Figure 4:
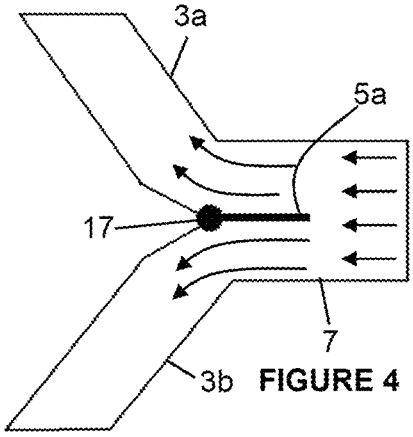
FIGS. 4, 5 and 6 are graphic representations of the first variant of the cooling circuit, which variant is configured in a second mode of operation, according to the embodiment of the invention.
Figure 5:
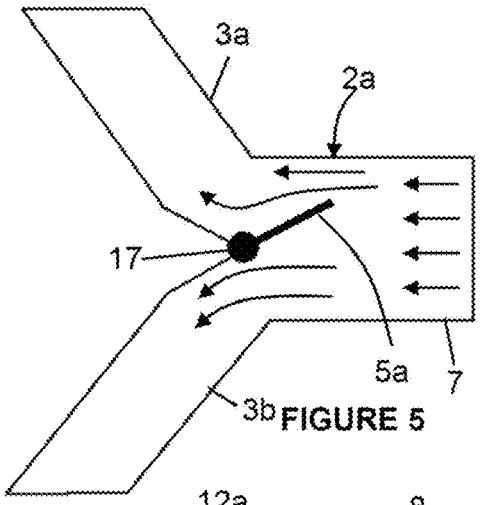
Figure 6:
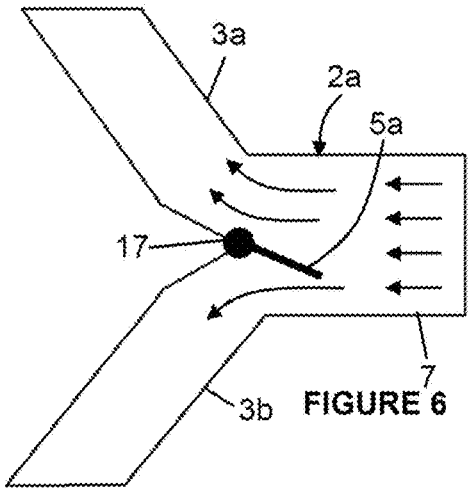

This sub-step 29 includes, when the headlight unit 1 is provided with the first variant of the cooling circuit 2*a*, a stage for driving 30 the varying element 5*a* as a function of the temperatures T1, T2 relating to the lighting modules 12*a*, 12*b* of the headlight unit 1. During this stage 30, the varying element 5*a* is driven by the control unit 18 as a function of the temperatures T1, T2 of the lighting modules 12*a*, 12*b*. These temperatures T1, T2 of the lighting modules 12*a*, 12*b* are measured and transmitted periodically to the control unit 18 which, for example using mapping data 21, determines the position of each varying element 5*a* in the cooling circuit 2*a*. This mapping data 21, which is archived in the memory elements 20 of the control unit 18 and results, for example, from empirical data, defines different positions of the varying element 5*a* as a function of the measured temperatures T1, T2 of the lighting modules 12*a*, 12*b* of the headlight unit 1. Thus, as a function of these temperatures T1, T2, the varying element 5*a* can then be configured in various positions while distributing a substantially equal proportion of the air flow into each of the air circulation pipes 3*a*, 3*b*, as illustrated in FIG. 4, or while distributing a larger proportion of air towards one of these pipes 3*a*, 3*b*, as shown in FIGS. 5 and 6.

When the headlight unit 1 is provided with the second variant of the cooling circuit 2*b*, the configuring sub-step 29 includes a stage for driving 31 at least one varying element 5*b*, 5*c* as a function of the temperatures T1, T2 relating to the lighting modules 12*a*, 12*b* of the headlight unit 1 and of the detection of a condensation phenomenon 32 appearing at the outer lens 9 of the headlight unit 1. During this stage 31, at least one varying element 5*b*, 5*c* is driven by the control unit 18 as a function of the temperatures T1, T2 of the lighting modules 12*a*, 12*b* and of the detection of the appearance of the condensation phenomenon 32. The temperatures T1, T2 of the lighting modules 12*a*, 12*b* are measured and transmitted periodically to the control unit 18. The parameters for detecting the appearance of the condensation phenomenon 32 in this headlight unit 1 are also determined and transmitted periodically to this control unit 18. These determined parameters can include, as has been seen above, estimated temperatures of the outer lens 9 of the headlight unit 1 and/or temperatures and humidity levels measured in the outer environment of the headlight unit 1. The control unit 18, using the measured temperatures T1, T2, and the result of the comparison of the temperature Tg of the outer lens with respect to the threshold temperature Tr and mapping data 21, then determines the position of each varying element 5*b*, 5*c* in the cooling circuit 2*b*. Thus, the varying element 5*b*, 5*c* can then be configured in various positions while distributing a substantially equal proportion of the air flow into each of the air circulation pipes 3*c* to 3*e* or into two air circulation pipes 3*c*, 3*d* as illustrated in FIG. 7 or while distributing a greater proportion of air towards one of these pipes 3*c* to 3*e*.

The invention also relates to a computer program including program code instructions for executing the steps 22, 23 of this method when said program is executed by the control unit 18 of the managing system 10.

Thus, the invention makes it possible to improve the cooling of the headlight unit 1 by distributing a proportion of the air flow generated by the device for generating 4 air flow into each air circulation pipe 3*a* to 3*e* of the cooling circuit 2*a*, 2*b*. This proportion is defined according to the position of said at least one varying element 5*a*, 5*b*, 5*c*, and is determined precisely depending on needs of components of the headlight unit 1 such as the lighting modules 12*a*, 12*b* and the outer lens 9 of this unit that are able to receive this proportion of the air flow. These needs correspond to a necessity to cool the lighting modules 12*a*, 12*b* and/or to reduce or eliminate the condensation phenomenon 32. A headlight supplied with such a cooling circuit according to the invention thus makes it possible to intelligently manage the cooling, making it possible to achieve compromises in order to optimize the effectiveness of the cooling, using a single cooling source, for example a single fan. The managing system can thus particularly deal with all of the extreme situations in an optimal fashion. For example, in a first situation where no lighting module is used and for which there is no condensation phenomenon, the device for generating 4 air flow can be stopped; this makes it possible to reduce energy consumption while increasing the life of the device for generating 4 air flow. In a second situation in which all of the modules are used and possibly for which there is a condensation phenomenon, the managing system can split the cooling between the various components using a precise proportion suited to the needs of each component, or can carry out adjustments to maintain an acceptable safety situation.

Moreover, the invention has the advantage of having a minimal spatial requirement and a low implementation cost.

Of course, the invention is not limited to the described embodiments. It is suitable for any situation in which several components of a same headlight need to be cooled. The elements of the device can have any other form without departing from the scope of the invention. In particular, the varying elements can have any form and/or be positioned at any other location of the pipes.

The invention claimed is:

1. A headlight unit, comprising a cooling circuit provided with at least two air circulation pipes linked to a device for generating an air flow, including a fan, and provided with at least one varying element for varying a proportion of the air flow, which proportion is distributed into each of the at least two air circulation pipes, wherein the headlight unit further includes an air circulation pipe different from the at least two air circulation pipes each of which being connected to a respective lighting module, and further including an outer lens, and wherein the end of the air circulation pipe different from the at least two air circulation pipes is connected to the outer lens.

2. The headlight unit according to claim 1, wherein the at least one varying element is a mobile wall arranged in a junction zone of an air inlet pipe of the cooling circuit with the at least two air circulation pipes.

3. The headlight unit according to claim 1, wherein the at least one device for generating an air flow is linked to an air inlet pipe of the cooling circuit.

4. A system for managing an air circulation in a headlight unit according to claim 1, further including:

a controller driving the at least one varying element for varying a proportion of the air flow, which proportion is distributed into each of the at least two circulation pipes of the cooling circuit of the headlight unit.

5. The system according to claim 4, including at least one device for generating an air flow, including a centrifugal fan, at least one temperature sensor, and/or at least one humidity sensor measuring the temperature and the humidity level, respectively, that are present in the outer environment of the headlight unit and/or at least one temperature sensor included in an enclosure of the headlight unit.

6. The system according to claim 4, including at least one temperature sensor arranged in a lighting module of the headlight unit.

7. A vehicle, including a motor vehicle, including at least one headlight unit according to claim 1.

8. The headlight unit according to claim 2, wherein the at least one device for generating an air flow is linked to an air inlet pipe of the cooling circuit.

9. A system for managing an air circulation in a headlight unit according to claim 2, including a controller driving at least one varying element for varying a proportion of the air flow, which proportion is distributed into each of the at least two pipes of the cooling circuit of the headlight unit.

10. The system according to claim 5, including at least one temperature sensor arranged in a lighting module of the headlight unit.

11. A method for managing an air circulation in a headlight unit including:

a cooling step, via a cooling circuit of the headlight unit that includes at least two air circulation pipes linked to a device for generating an air flow, including a fan; and a varying step for varying the air flow proportion distributed into each of the at least two air circulation pipes of the cooling circuit of the headlight unit, wherein the headlight unit further includes an air circulation pipe different from the at least two air circulation pipes each of which being connected to a respective lighting module, and further including an outer lens, and wherein the end of the air circulation pipe different from the at least two air circulation pipes is connected to the outer lens.

12. The method according to claim 11, wherein the varying step includes a configuring sub-step for configuring the cooling circuit in a first mode of operation in which the entire air flow is guided towards a single lighting module or an outer lens or in a second mode of operation in which the air flow is split between at least two air circulation pipes.

13. The method according to claim 11, wherein the varying step includes a configuring sub-step for configuring the cooling circuit which configuring sub-step takes into account all or some of the following data:

the on or off state of each lighting module;

the temperature of at least one lighting module;

the temperature inside the headlight and/or outside;

the humidity level measured in the outer environment of the headlight unit.

14. The method for managing an air circulation in a headlight unit according to claim 11, wherein the step for varying the air flow proportion distributed into each of the at least two air circulation pipes of the cooling circuit of the headlight unit is performed via at least one varying element comprising a mobile wall arranged in a junction zone of an air inlet pipe of the cooling circuit with the at least two air circulation pipes.

15. The method according to claim 12, wherein the configuring sub-step takes into account all or some of the following data:

the on or off state of each lighting module;

the temperature of at least one lighting module;

the temperature inside the headlight and/or outside;

the humidity level measured in the outer environment of the headlight unit.

16. A non-transitory computer-readable medium including a computer program comprising program code instructions which when executed by a controller of a managing system, cause the managing system to perform:

a cooling step via a cooling circuit of a headlight unit that includes at least two air circulation pipes linked to a device for generating an air flow, including a fan; and a varying step for varying the air flow proportion distributed into each of the at least two air circulation pipes of the cooling circuit, wherein the headlight unit further includes an air circulation pipe different from the at least two air circulation pipes each of which being connected to a respective lighting module, and further including an outer lens, and wherein the end of the air circulation pipe different from the at least two air circulation pipes is connected to the outer lens.

* * * * *